US005416566A

United States Patent [19]

Edmunds et al.

[11] Patent Number: 5,416,566

[45] Date of Patent: May 16, 1995

[54] DEVELOPMENT APPARATUS HAVING AN IMPROVED DEVELOPER FEEDER ROLL

[75] Inventors: Cyril G. Edmunds; Jorge A. Alvarez, both of Webster; Victoria F. DeYoung, Rochester, all of N.Y.

[73] Assignee: Xerox Corporation, Stamford, Conn.

[21] Appl. No.: 257,246

[22] Filed: Jun. 8, 1994

[51] Int. Cl.[6] ..... G03G 15/09

[52] U.S. Cl. ..... 355/253; 118/657; 355/247; 355/251

[58] Field of Search ..... 355/245, 247, 251, 252, 355/253, 259, 260; 118/656, 657, 658

[56] References Cited

U.S. PATENT DOCUMENTS

| | | | |
|---|---|---|---|
| 4,034,709 | 7/1977 | Fraser et al. | 118/658 |
| 4,558,943 | 12/1985 | Patz . | |
| 4,786,936 | 11/1988 | Ikegawa et al. | 355/253 |
| 4,982,689 | 1/1991 | Honda et al. | 118/656 |
| 4,989,044 | 1/1991 | Nishimura et al. | 355/251 |
| 5,153,376 | 10/1992 | Tomita | 118/657 |
| 5,245,392 | 9/1993 | Behe et al. | 355/259 |
| 5,286,917 | 2/1994 | Unno et al. | 118/657 X |
| 5,315,354 | 5/1994 | Mordenga | 355/260 |

FOREIGN PATENT DOCUMENTS

| | | | |
|---|---|---|---|
| 4-162060 | 6/1992 | Japan | 355/253 |

OTHER PUBLICATIONS

Makhijani, Suresh P., "Textured Magnetic Brush Roll", Xerox Disclosure Journal, vol. 4, No. 3, May/Jun. 1979, p. 303.

Hewitt, R. E., "Etched Developer Roll", Xerox Disclosure Journal, vol. 4, No. 4, Jul./Aug. 1979, p. 447.

*Primary Examiner*—A. T. Grimley
*Assistant Examiner*—Sandra L. Brase
*Attorney, Agent, or Firm*—Tallam I. Nguti

[57] ABSTRACT

A development apparatus includes a housing defining a chamber holding a supply of two-component developer material consisting of toner, and magnetizable carrier beads. The development apparatus also includes an extended life, increased reliability magnetic roll assembly within the housing for repeatably transporting a desired quantity of attracted developer material, fed from the chamber, for movement through the development zone. The improved magnetic roll assembly includes a rotatable non-conductive shell or substrate surrounding a magnetic member so as to prevent the creation of eddy currents in the substrate during its rotation. The substrate has an elastomeric coating layer formed over it. The elastomeric coating layer has a mechanically deformable smooth surface for effectively holding, even at relatively high rates of speed, the quantity of attracted developer material thereon being transported. The smooth surface is deformable by magnetized carrier beads acting under the influence of the magnetic member.

25 Claims, 6 Drawing Sheets

DEVELOPMENT APPARATUS HAVING AN IMPROVED DEVELOPER FEEDER ROLL

This invention relates generally to electrostatographic reproduction machines, and more particularly concerns a development apparatus having an improved developer feeder roll.

Generally, the process of electrostatographic reproduction includes uniformly charging a photoconductive member, or photoreceptor, to a substantially uniform potential, and imagewise discharging it or imagewise exposing it to light reflected from an original image being reproduced. The result is an electrostatically formed latent image on the photoconductive member. The latent image so formed is developed by bringing a charged developer material into contact therewith. Two-component and single-component developer materials are commonly used. A typical two-component developer material comprises magnetic carrier particles, also known as "carrier beads," having charged toner particles adhering triboelectrically thereto. A single component developer material typically comprises charged toner particles only. In either case, the charged toner particles when brought into contact with the latent image, are attracted to such image, thus forming a toner image on the photoconductive member. The toner image is subsequently transferred to a receiver sheet which is then passed through a fuser apparatus where the toner image is heated and permanently fused to the sheet forming a copy of the original image.

To develop a latent image in an electrostatographic reproduction machine, charged toner particles are brought, by a development apparatus, into contact with the latent image formed as described above. For such development using two-component developer material, the development apparatus typically includes a housing defining a chamber within which the developer material is mixed and charged. Moving and mixing two-component developer material triboelectrically and oppositely charges the "carrier beads" and the toner particles causing the toner particles to adhere to the carrier beads.

As disclosed for example in U.S. Pat. No. 5,245,392, and U.S. Ser. No. 07/091858 both assigned to the assignee of the present application, one type of a two-component development apparatus includes a housing, a mixing chamber, a development zone, and a donor member for transporting charged toner particles from the mixing chamber to the development zone. A plurality of electrode wires are closely spaced relative to the donor member within the development zone. An AC voltage is applied to the electrode wires for forming a toner cloud in the development zone. Electrostatic fields generated by an adjacent latent image serve to attract charged toner particles from the toner cloud, thus developing the latent image.

As also disclosed, it is conventional to provide in such an apparatus, a conductive, usually metallic magnetic roll for transporting developer material from the mixing chamber to the donor member. The magnetic roll is mounted rotatably between the mixing chamber and the donor member, and serves to magnetically attract and hold magnetizable carrier beads (which have charged toner particles triboelectrically adhering thereto) onto its toughened or knurled surface. The charged toner particles are then electrostatically attracted from the carrier beads on the roughened or knurled surface of the magnetic roll onto the donor member for transporting to the development zone.

The uniformity and quality of latent images developed in the development zone depend significantly on the quantity and uniformity of developer material repeatably transported by the magnetic roll to the donor member. As disclosed for example in each of the following references, the quantity and uniformity of developer material transported by such a magnetic roll are determined primarily by the surface roughness of the magnetic roll. For example, in this regard U.S. Pat. No. 4,034,709 (issued Jul. 12, 1977 to Fraser et al.) discusses the importance of, and several ways of, roughening the surfaces of magnetic developer rolls. In particular, it discloses such a magnetic developer roll that includes a rough styrene-butadiene surface-coating for holding and directly transporting developer material through a development zone.

Xerox Disclosure Journal (Vol. 4, No. 3 May/June 1979) discloses a magnetic roll in which desired surface roughness is obtained by covering the roll with a netting material such as nylon stockings. Xerox Disclosure Journal (Vol. 4, No. 4 July/August 1979) on the other hand discloses a similar magnetic roll that is roughened by forming a multiplicity of small, shallow depressions in its surface. As a further example, U.S. Pat. No. 4,558,943 (issued Dec. 17, 1985 to Patz) discloses a similar magnetic roll that is roughened by forming valleys in its surface which are then filled with a polymeric material.

As can be expected, when such rolls are used to transport two-component developer material containing carrier beads which can be abrasive, the carrier beads tend to wear out the desired roughness of their surfaces over time. Such wearing out of the surface roughness of a roll disadvantageously and eventually reduces the frictional characteristics of the surface, and hence its ability to repeatably transport desired quantities of developer material. This particular disadvantage is further aggravated in development apparatus that are required to operate at substantially high rates of speed. In such an apparatus, the magnetic roll is accordingly required to rotate at a substantially high number of revolutions per unit time. As can be expected, at such high rates of rotation, centrifugal forces, for example, make it increasingly difficult for the rotating roll to hold onto developer material on its worn out surface. There is therefore a need for an improved magnetic roll with a surface that substantially resists wear and tear from carrier beads in two-component developer, and that continues to exhibit acceptable holding ability at high speeds on developer material being transported thereby.

Conventionally too, such magnetic rolls typically include a conductive substrate or shell, such as an aluminum shell, that is coated variously. It has been found that the rotation of the conductive shell of such a roll through a magnetic field, of the magnet within its core induces eddy currents through out the conductive shell. Such eddy currents as is well known, result in power losses as well as in reductions in the magnetic flux of the magnetic field. Such power losses for a high speed roll have been found to be as much as 19% of the free-space power required for driving the roll. Such losses also undesirably cause eddy current heating within the housing of the loss development apparatus. There is therefore also a need for an improved magnetic roll that overcomes such eddy current related disadvantages.

SUMMARY OF THE INVENTION

In accordance with one aspect of the present invention, there is provided a development apparatus for developing a latent image recorded on an image bearing surface. The development apparatus includes a housing that defines a chamber holding a supply of magnetizable developer material. The magnetizable developer material is comprised of toner particles and magnetic carrier beads. The development apparatus also includes a rotatable magnetic roll assembly mounted within the housing. The rotatable magnetic roll assembly has a path of rotation for moving a quantity of the developer material therealong, includes a magnetic member that generates a strong magnetic field at a first point along the path of rotation. The rotatable magnetic roll assembly also includes a rotatable cylindrical shell surrounding the magnetic member. The cylindrical shell has an outer surface that moves along the path of rotation, and an elastomeric coating that is formed onto the outer surface. The elastomeric coating so formed has a smooth surface for holding a quantity of the developer material that is magnetically attracted thereonto by the magnetic member. The smooth surface has a durometer hardness within a range of 60a to 70d, thereby enabling magnetic carrier beads in the quantity of developer material being held magnetically thereon to form temporary decompressions into the smooth surface for frictionally holding the quantity of developer material thereon even at substantially high rates of speed.

In accordance with another aspect of the present invention, there is provided a high speed development apparatus for developing latent images recorded on an image bearing surface. The apparatus includes a housing defining a mixing chamber for holding and mixing a supply of magnetizable two-component developer material that includes toner particles and magnetizable carrier beads. A moving donor member, for positioning spaced from the image bearing surface, transports toner particles to a development zone adjacent the image bearing surface. A plurality of biased electrode wires, located within the development zone, creates a powder-cloud of the toner particles which are then attracted by a latent image on the image bearing member for image development. A movable feeder member is positioned adjacent a magnetic device and so as to be between the mixing chamber and donor member. A desired quantity of the magnetizable developer material from the mixing chamber is attracted by the magnetic device onto the feeder member for holding and transportation to the donor member. For preventing such a desired quantity of magnetizable developer material from slipping off the moving feeder member when it is rotated at a substantially high rate of speed, the feeder member includes a smooth surface outer layer that is mechanically deformable by magnetizable carrier beads thereon acting under the magnetic influence of the magnetic device.

BRIEF DESCRIPTION OF THE DRAWINGS

Other features of the present invention will become apparent as the following description precedes and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Inasmuch as the art of electrostatographic reproduction is well known, the various processing stations employed in an exemplary electrostatographic reproduction machine will be shown hereinafter schematically, and their operations described only briefly.

Figure 5:
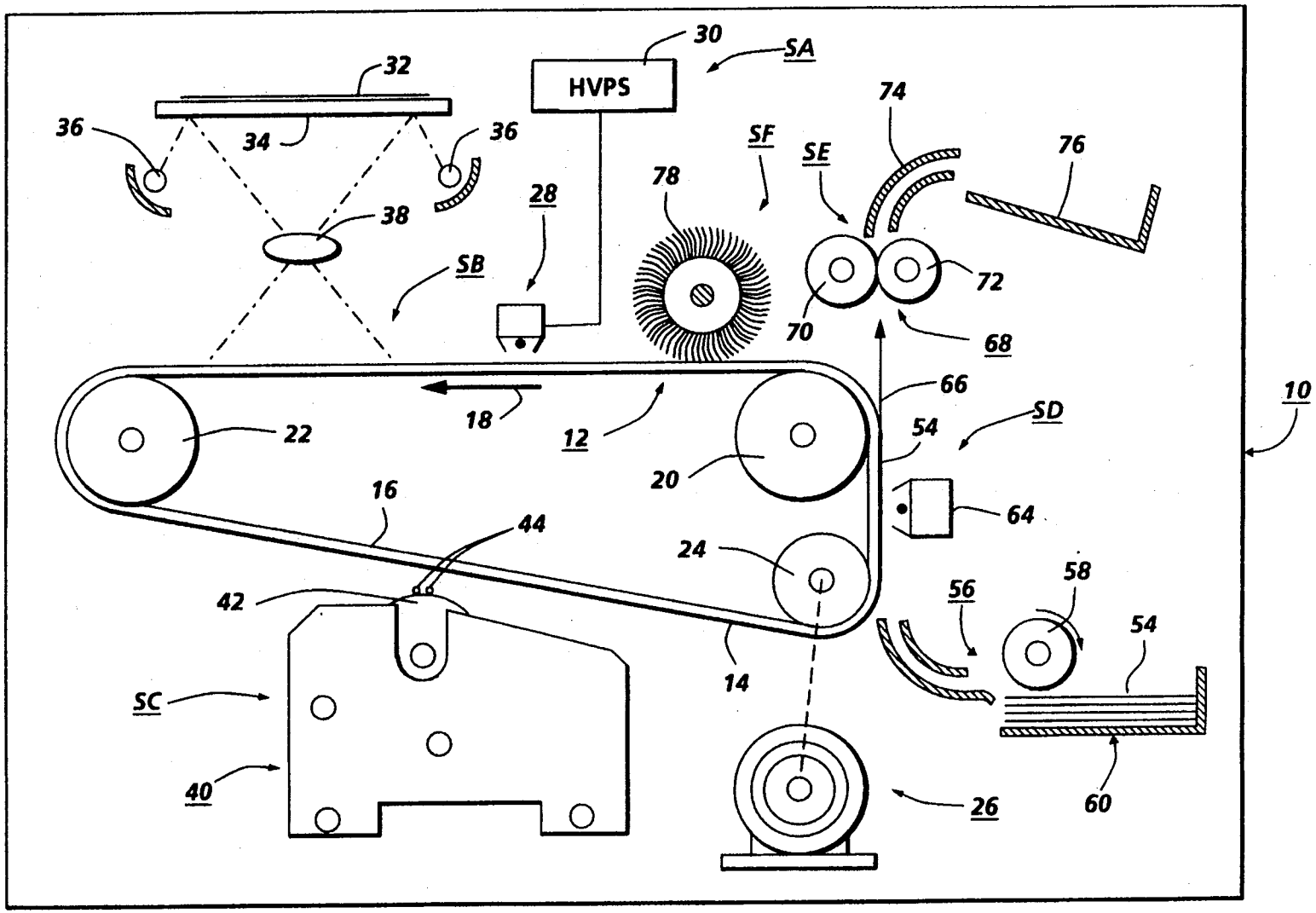
FIG. 5 is a schematic elevational view of an illustrative electrostatographic reproduction machine incorporating development apparatus of the present invention.

Referring initially to FIG. 5, there is shown an exemplary electrostatographic reproduction machine 10 incorporating the development apparatus of the present invention. The electrostatographic reproduction machine 10 for example employs a belt type image bearing member 12 having a photoconductive surface 14 formed over an electrically grounded conductive substrate 16. One skilled in the art, however, will appreciate that another suitable arrangement of a photoconductive image bearing member may be used. As shown, belt 12 moves in the direction of arrow 18 to advance successive portions of photoconductive surface 14 sequentially through the various processing stations disposed about the path of movement thereof. Belt 12 is entrained about stripping roller 20, tensioning roller 22, and drive roller 24. Drive roller 24 is mounted rotatably in engagement with belt 12. Motor 26 is coupled to, and rotates roller 24 in order to advance belt 12 in the direction of arrow 18. Belt 12 is maintained in tension by a suitable pair of springs (not shown) resiliently urging tensioning roller 22 against belt 12 with a desired spring force. Stripping finger 20 and tensioning roller 22 are mounted to rotate freely.

Initially, a portion of belt 12 passes through charging station SA where a corona generating device, indicated generally by the reference numeral 28, charges photoconductive surface 14 to a relatively high, and substantially uniform potential. High voltage power supply 30 is coupled to corona generating device 28, and excitation of the power supply 30 causes corona generating device 28 to charge a portion of the photoconductive surface 14 of belt 12. After such charging, the charged portion is advanced, as belt 12 is moved, to exposure station SB.

At exposure station SB, lamps 36 flash light rays for reflection onto an original document 32 that is placed face down upon a transparent platen 34. The light rays reflected imagewise from the original image of document 32 are transmitted through lens 38 to form a light image thereof. Lens 38 focuses the imagewise light rays onto the charged portion of photoconductive surface 14 at exposure station SB and thus selectively dissipates the charge thereon to form a latent image. The latent image thus formed on photoconductive surface 14 corresponds to the informational areas contained within the original image of document 32. For such image wise exposure of photoconductive surface 14, a raster output scanner (ROS) (not shown) may alternatively be used in lieu of the lamps and light lens system previously described. As is well known, the ROS can be used as such to layout an image in a series of horizontal scan lines with each line having a specified number of pixels per inch.

After the electrostatic latent image has been formed thus on photoconductive surface 14, belt 12 advances the latent image to development station SC. At development station SC, the development apparatus of the present invention, indicated generally by the reference numeral 40, (to be described in detail below) develops the latent image recorded on the photoconductive surface 14 to form a toner image. Belt 12 then advances the toner image to transfer station SD where a copy sheet 54 is advanced by sheet feeding apparatus 56 into a transfer relation with the toner image. Preferably, sheet feeding apparatus 56 includes a feed roll 58 contacting the uppermost sheet of a stack 60 of such sheets. Transfer station SD also includes a corona generating device 64 which sprays ions onto the back side of sheet 54 to attract the toner image from photoconductive surface 14 onto sheet 54. After such image transfer, sheet 54 is separated from the belt 12 and moved in the direction of arrow 66 onto a conveyor (not shown) which advances sheet 54 to fusing station SE.

As shown, fusing station SE includes a fuser assembly indicated generally by the reference numeral 68 that has a pair of fusing rolls. The fusing assembly rolls 68 preferably include a heated fuser roller 70 and a back-up pressure roller 72. Sheet 54 is passed between fuser roller 70 and back-up roller 72 so that the toner image thereon contacts heated fuser roller 70. In this manner, the toner image is heated, fused and permanently affixed to sheet 54 forming a sheet copy of the original image of document 32. The sheet copy now on sheet 54 is then advanced through a chute 74 to a catch tray 76 for subsequent removal from the reproduction machine 10.

Meanwhile, belt 12 next moves the portion of the surface 14 from which the image had been transferred to the copy sheet 54 to a cleaning station SF where residual toner particles are cleaned or removed. Cleaning station SF, for example, includes a rotatably mounted fibrous brush 78 that rotates in contact with photoconductive surface 14 for cleaning by removing the residual toner particles. Subsequent to such cleaning, a discharge lamp (not shown) floods photoconductive surface 14 with light in order to dissipate any residual electrostatic charge remaining thereon from the prior imaging cycle.

It is believed that the foregoing description is sufficient for purposes of the present application to illustrate the general operation of an electrostatographic reproduction machine incorporating the development apparatus of the present invention. Typically, the speed of such electrostatographic reproduction machines is measured in terms of a number of sheet copies produced per unit time. Among different families of such machines, speed therefore varies significantly from a low between 10 and 20 copies per minute to a high of greater than 100 copies per minute. For such machines to produce high quality copies or reproductions of original images, the processing stations (including the development station SC), must be designed so as to function effectively at a desired speed of the machine. For example, the development station SC therefore must be capable of functioning as such, even at substantially high machine speeds, to repeatably deliver a uniform, desired quantity of toner particles to the development zone for latent image development.

Figure 1A:
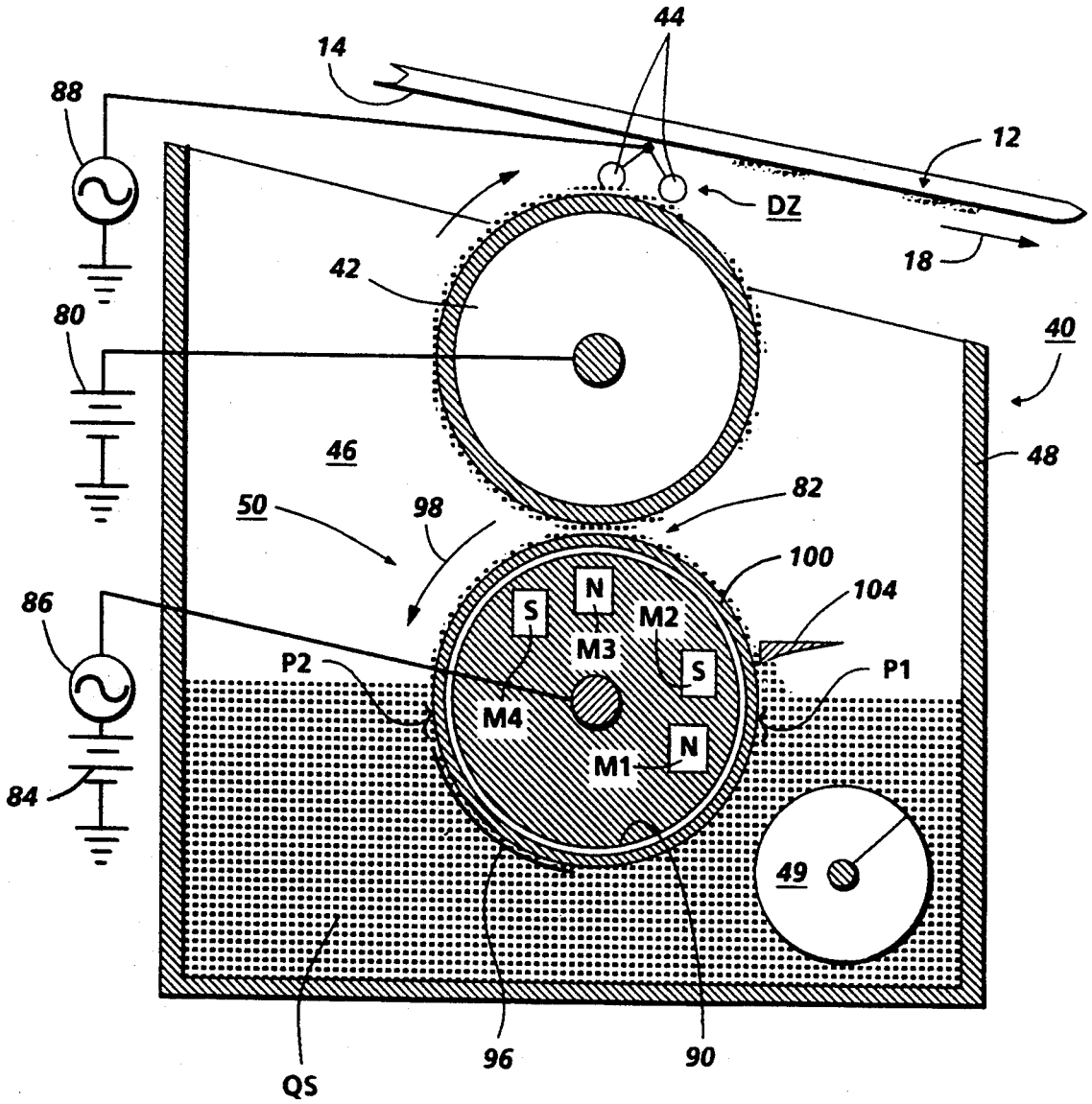
FIG. 1A is a simplified elevational view of one embodiment of a development apparatus according to the present invention.

Referring now to FIG. 1A, there is shown one embodiment of the development apparatus 40 of the present invention. The development apparatus 40 includes improved elements that enable an extended life, and the repeatable delivery of a uniform, desired quantity of toner for high speed latent image development. As shown, development apparatus 40 includes a movable donor member shown as a roll 42 that is mounted, at least partially, within a mixing chamber 46. Mixing chamber 46 is defined by housing 48, and holds a supply QS of developer material consisting of toner particles and carrier beads. The donor member 42 is moved to transport toner particles fed from the chamber 46 into contact with cloud producing electrode wires 44 within a development zone DZ for latent image development. The developer material QS typically is a two-component developer material comprising at least magnetizable carrier beads and the toner particles. As is well known, the developer material is moved and mixed within the mixing chamber 46 by a mixing device 49 in order to oppositely and triboelectrically charge such carrier beads and toner particles respectively. As a consequence of such charging, the oppositely charged toner particles adhere triboelectrically to the charged magnetizable carrier beads. Importantly, the development apparatus 40 includes the developer feeder assembly or magnetic roll 50 of the present invention (to be described in detail below). As shown, the feeder assembly 50 is shown disposed interiorly of the chamber 46 for feeding a quantity QF of developer material from the chamber 46 to the donor member 42. The magnetic roller 50 and the donor member 42 are electrically biased relative to each other so that charged toner particles within the quantity QF of developer material fed to the donor member 42 are attracted from the magnetic roll 50 to such donor member 42. Positioned within the mixing chamber 46 in the bottom of housing 48 is the mixing device 49, such as a horizontal auger, which distributes developer material uniformly along the length of magnetic roll 50, so that the lowermost part of magnetic roll 50 is always substantially immersed in a body of developer material QS.

As further shown in FIG. 1A, the donor member 42 is biased to a specific voltage, by a DC power supply 80 in order to enable the donor member 42 to attract charged toner particles off of magnetic roll 50 in a nip 82. To enhance the attraction of charged toner particles from the chamber 46, magnetic roll 50 is also biased by a DC voltage source 84. It is also biased by a AC voltage source 86 that functions to temporarily loosen the charged toner particles thereon from their adhesive and triboelectric bonds to the charged, magnetized carrier beads. Loosened as such, they can be attracted more easily to the donor member 42. AC voltage source 86 can be applied either to a conductive layer of the magnetic roll 50 as shown in FIG. 1, or directly to the donor roll in series with the DC supply 80. Similarly as shown, an AC bias is also applied to the electrode wires 44 by an AC voltage source 88 and serves to loosen charged toner particles from the donor member 42, as well as to form a toner cloud within the development zone DZ.

Figure 1B:
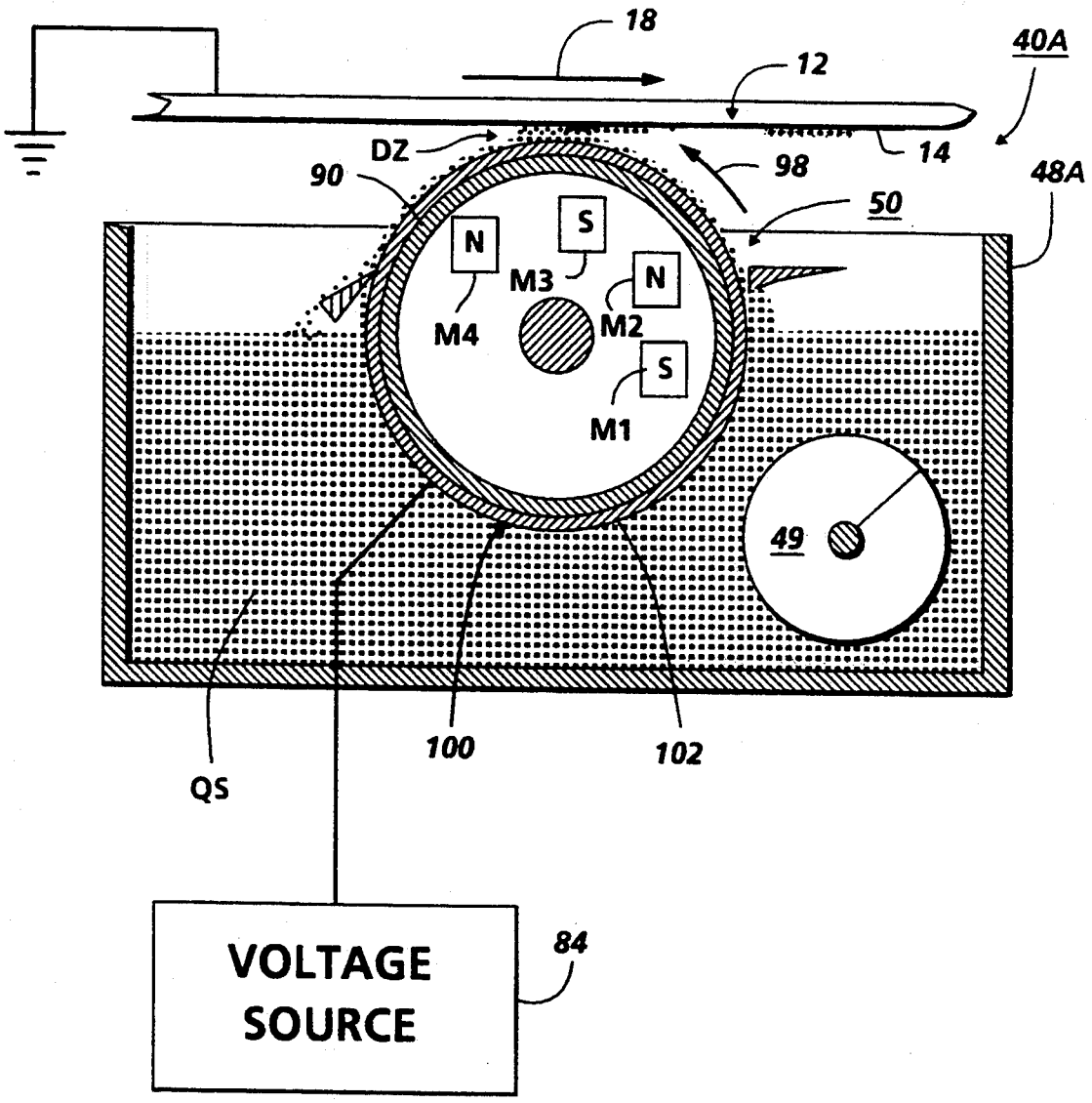
FIG. 1B is a simplified elevational view of a second embodiment of a development apparatus according to the present invention.

Referring now to FIG. 1 B, there is shown another embodiment 40A of the development apparatus of the present invention. In this embodiment, like elements as in FIG. 1A are shown with like reference numerals. Importantly, the development apparatus 40A also includes the improved elements that enable an extended life, as well as the repeatable delivery of a uniform, desired quantity of toner for high speed latent image development. In FIG. 1B, because of its longer life and increased developer material moving capability, the feeder assembly 50 is being used effectively, in a magnetic brush development apparatus housing 48A as a magnetic brush developer roll. As is well known, a magnetic brush developer roll as such receives developer material from the mixing chamber 46 and transports it directly into and through the development zone DZ for image development. It should be noted that although the improved developer feeder assembly 50 of the present invention (FIGS. 1A, 1B) is shown as a roll, the improvement design concepts therein are equally applicable to a belt type feeder assembly.

Figure 2:
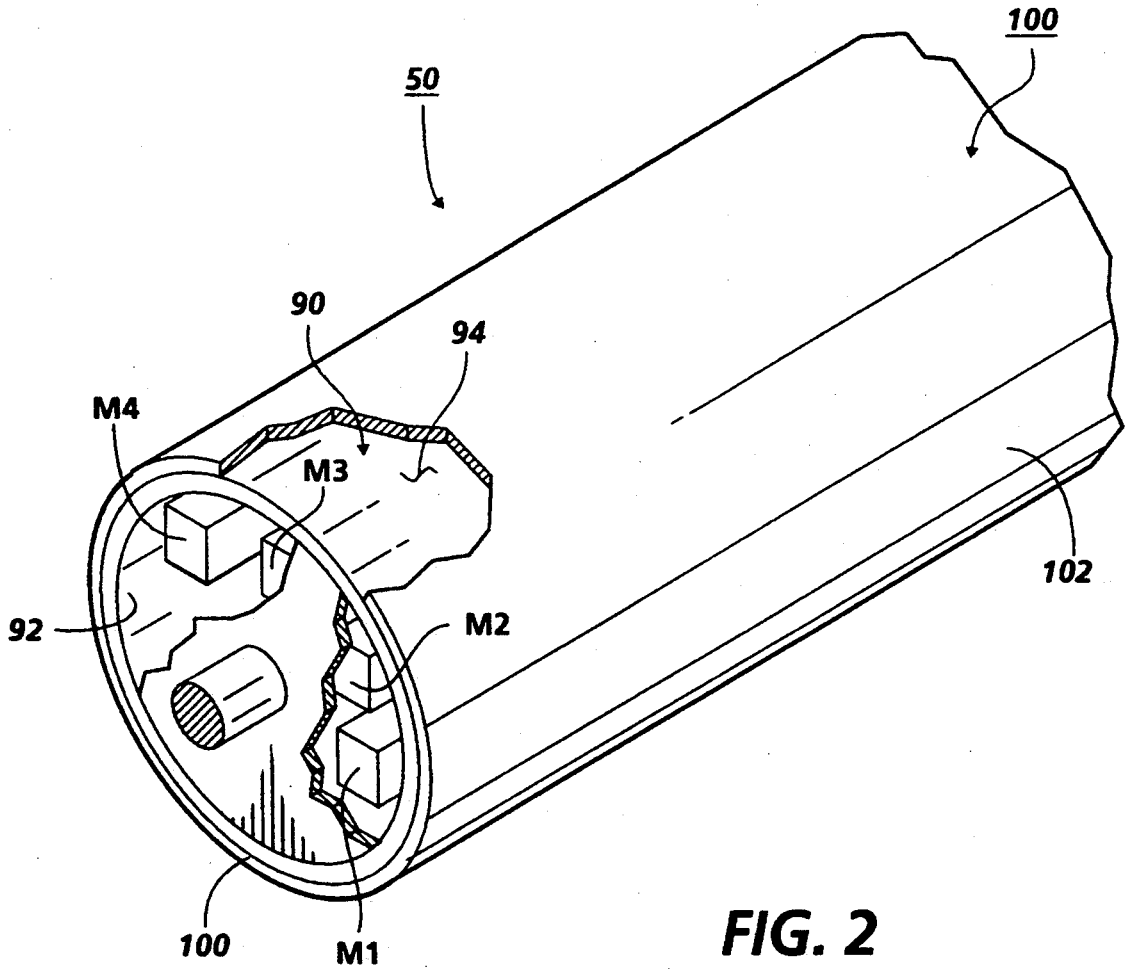
FIG. 2 is a perspective view of a cutout section of the magnetic developer feeder roll of the present invention.
Figure 3:
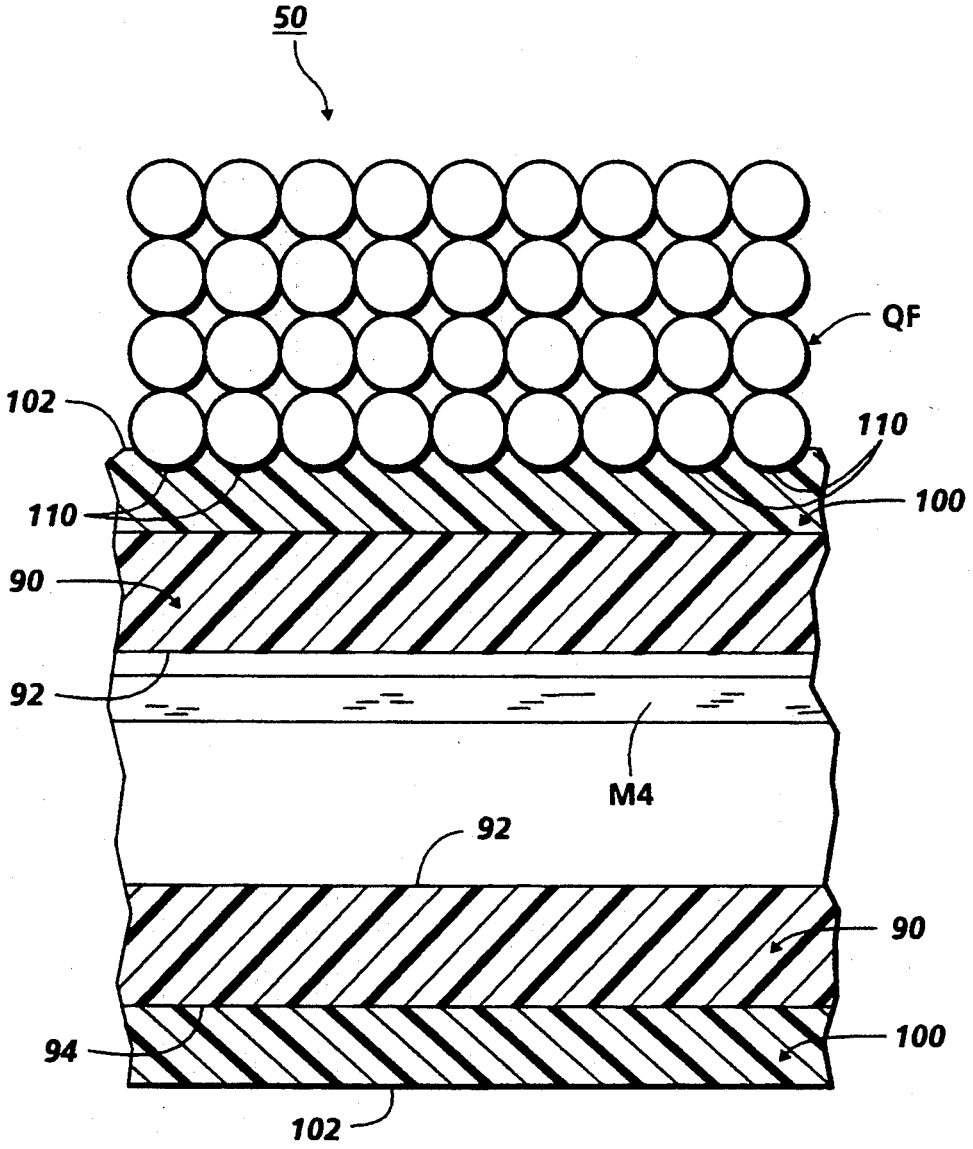
FIG. 3 is a detailed sectional view of a portion of the magnetic roll of FIG. 2 showing magnetic decompression of the smooth surface thereof within a transport magnetic field.

Referring now to FIGS. 2 and 3, details of the magnetic roll or developer feeder assembly 50 of the present invention are illustrated. In accordance with the objectives of the present invention, the developer feeder assembly or roll 50 is designed so as to have a substantially longer life relative to conventional roughened surface metallic rolls. It is also designed so as to be able to maintain a high level of high speed developer feeding reliability over such life. It is further designed so as to significantly reduce or eliminate the occurrence of eddy currents and eddy current related disadvantages such as power losses and undesirable eddy current heating.

Returning now to FIGS. 2 and 3, the developer feeder assembly or roll 50 of the present invention includes a movable substrate or shell 90 that has a first surface 92, a second surface 94 and a path of movement or rotation 96 (shown by the arrow 98) defined substantially by the second surface 94. The feeder assembly 50 also includes at least a magnetic member such as the magnetic members M1, M2, M3, M4 positioned interiorly of the first surface 92 of the substrate or shell 90, as well as adjacent the path of movement 96 thereof. The path of movement 96 is continuous and surrounds the position of the magnetic members. As positioned, each magnetic member M1 to M4 generates a strong magnetic field about a point along the path of movement 96, for example, about a first point P1 which is the pick up or loading point for the feeder assembly 50 within the chamber 46. As also shown, the feeder assembly 50 further includes a thin elastomeric coating or layer 100 that is formed onto the second surface 94 of the movable shell 90. The elastomeric coating 100 importantly has a mechanically deformable smooth surface 102 for holding, during transportation, a quantity QF of magnetic or magnetized developer material (FIG. 3) that is attracted thereonto by the magnetic members M1 to M4 as positioned on the opposite side of the movable substrate or shell 90.

Referring in particular to FIG. 2, magnetic members M1 to M4 are stationary permanent magnets, for example, that are each coextensive in length with, and are positioned closely spaced from, the first or interior surface 92 of the movable shell 90. The shell 90 preferably is non-magnetic (to be described further below), and is designed to be rotated about the magnetic members M1 to M4 in a direction indicated by the arrow 98. Because the two-component developer material QS in the chamber 46 includes magnetic or magnetizable carrier beads, the effect of the shell 90 rotating through the strong stationary magnetic fields of M1 to M4 is to cause the quantity QF of such developer material to be attracted to the exterior of the shell 90. As also shown, a doctor blade 104 may be used to limit the radial depth of developer on the surface 102 as it rotates through a toner-transfer nip 82 (FIG. 1A) with the donor member 42.

The field strength of the peak radial field of the magnetic members around the pick up or loading point P1 of the feeder assembly or magnetic roll 50 preferably is about 600 gauss. As also shown, other points, for example point P2, along the path of movement of the movable shell 90 include no, or at best a weak magnetic field. The surface of the magnetic roll 50 should be about 2.5 mm away from the top of the magnetic members. The radial field of each magnetic member is commonly the component of the magnetic field thereof that is directed radially outward relative to the axis of the magnetic member. The tangential component of each magnetic field is tangent to the circumference of the roll 50, and will often be defined when all the radial peaks are defined and specified. The polarity of each magnetic field can be North or South, but preferably should be alternating from magnetic member to magnetic member as shown. The magnetic force generated by the gradient of the resulting magnetic field together with the inventive characteristics of the elastomeric coating 72 (to be detailed below) are particularly important for the functioning of the present invention. This magnetic force, which acts on magnetized developer material QF on the surface of the elastomeric coating, effectively enables reliable high speed, and extended life, feeding of developer material QF from the chamber 46 of the apparatus 10. In accordance with the present invention, the permeability ($\mu$) of the developer material is preferably within a range of 4 to 6, and the magnetic force acting on a mass of such developer material is typically 40–80 times larger than a force that would be generated by gravity on the same mass of developer material.

Still referring to FIGS. 2 and 3, when the feeder assembly 50 is a roll as shown, its cylindrical substrate or shell 90, for example, is usually about 475 mm long in the development apparatus 10. At such a length, the beam strength requirements are such that the Modulus of Elasticity (E) thereof should be at least 300,000 pounds per square inch. Furthermore, because the thickness of the shell affects the magnetic field strength therethrough, the shell 90 preferably has an inner diameter of 38.6 mm, and an outside diameter of 42.0 mm. As such, the roll 50 advantageously should have an allowable center deflection of about 0.0016 inch when the roll is fully loaded with developer material QF.

In order to meet these various requirements, the substrate or shell 90, for example, can be made out of a general purpose polycarbonate. An important consideration for selecting shell material is that the selected material has to be compatible with elastomeric coating 100. Compatibility results in good adhesion which is important for the desired long, or extended service life of the feeder assembly. As such, other materials that can be used are, for example, phenolics having a Modulus of elasticity (E) of about 900,000 psi, and polyesters having a Modulus of elasticity (E) of about 400,000 psi. Thermo plastics materials as well as thermo setting materials of the sort that are compatible with the elastomeric coating 100 can be used. It has been found that the higher the (E) value of the material used for the shell, the thinner the walls of the shell can be made. Thinner walls can advantageously lead to increased magnetic field strength at the outside surface of the shell. They can also simplify manufacturing by allowing for larger clearances between the magnetic members and the inside surface 92 of the shell. More importantly, the shell 90 can be made out of a high strength urethane based polyester which would eliminate the need for an elastomeric coating 100 thereover. The modulus of elasticity E for such a urethane based polyester shell is about 300,000 psi with a durometer value of about 70d, which would result in a roll shell capable of receiving small magnetic force induced decompressions 110. The roll 50 as a whole when made as such would have a volume resistivity of $10^8$ ohm-cm throughout.

In accordance with another objective of the present invention, the movable substrate or shell 90 is advantageously made electrically non-conductive in order to eliminate or prevent the occurrence of eddy currents that would be generated within a movable electrically conductive shell due to the presence of the magnetic members M1 to M4 within its core. An eddy current is an electric current that is induced within the body of a conductor when that conductor either moves through a non-uniform magnetic field, or is in a region where there is a changing magnetic field. The movement of the shell 90 about magnetic members M1 to M4 represents such a set up if the shell 90 is conductive.

Figure 4:
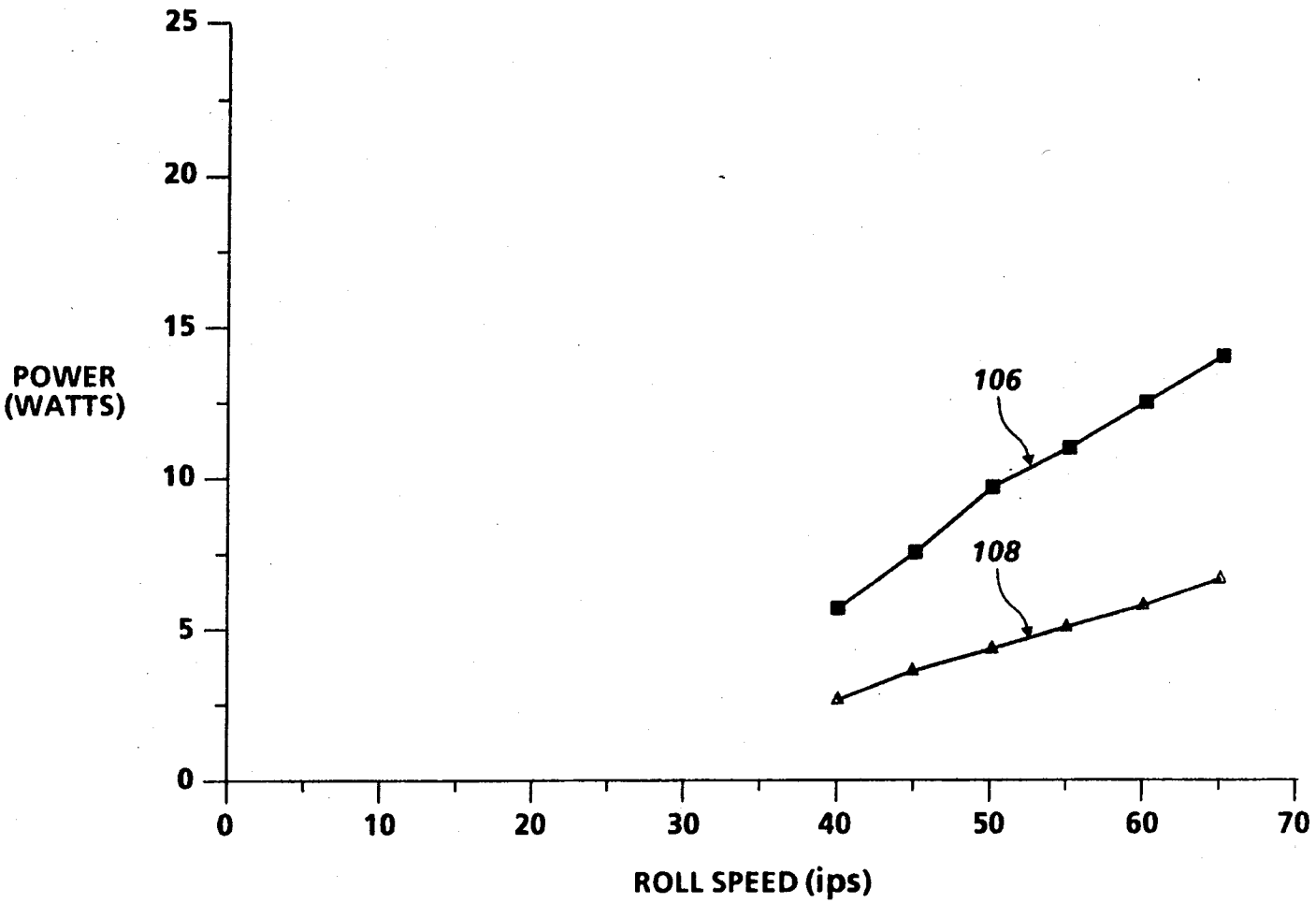
FIG. 4 is a graphical illustration of eddy current power gains expected from use of the magnetic developer feeder roll of the present invention.

Referring to FIG. 4 for example, a chart showing eddy current losses is illustrated. The chart shows two lines 106, and 108, each representing the total power needed to drive the development apparatus 10 under eddy current, and non-eddy current conditions, respectively. To generate the top line 106, a test was conducted using a conventional feeder assembly 50A (not shown) that included a conventional conductive aluminum shell, along with magnetic members positioned within its core. The conductive shell was driven, and its surface speed was measurably varied from 40 IPS (inches per second) to 65 IPS. This test represented eddy current generating conditions. The total power required to run the apparatus 10 was recorded at the various speeds (see top line 106).

For non-eddy current conditions, a second test was conducted under conditions where the magnetic members were removed from the core of the conductive shell. This was equivalent to removing the conductive shell instead, and mounting an electrically non-conductive shell around the magnetic members. In either case, no eddy currents (generated or not) would flow in the shell under these conditions. The shell and the rest of the apparatus 10 were again driven, and the surface speed thereof was measurably varied the same as above. The total power required to run the apparatus 10 was again recorded at such speeds (see the lower line 108). It is quite clear from these plots of the lines 106, 108 that more total power was required under the first test (eddy current) conditions than under the second (non-eddy current) conditions to run the apparatus 10. At each plotted point, the difference in required total power amounts to an eddy current power loss at that speed for the apparatus 10. As measured and plotted, these losses for example were 2.7 watts at 40 ips, and 6.4 watts at 65 ips, which are losses ranging from 15% to 19%. The use of an electrically non-conductive shell around the magnetic members M1 to M4, (a condition under which no eddy currents will flow through the shell), would therefore be significantly advantageous.

Referring still to FIGS. 2 and 3, the elastomeric coating 100 is a thin coating made for example from electrically conductive urethane material that has a thickness within a range of 0.040 to 0.060 inch. The smooth surface 102 thereof has a preferred durometer hardness within a range of 60a to 70d. As such, the smooth surface 102 can be magnetically deformed temporarily and easily, by a magnetic force (not shown) of any of the strong magnetic fields of M1 to M4 acting on magnetized carrier beads of the developer material QF on such smooth surface. Such deformation results in decompressions 110 (FIG. 3) that reliably provide a frictional structure for holding the attracted developer material QF onto the surface of the rotating shell, even when the shell is being rotated at substantially high rates of speed. Given such impact of the magnetic forces on the smooth surface 102, it is clear that when being rotated with the shell 90, the smooth surface 102 will be temporarily decompressed for example when at the first point P1 along the path of movement, but would resiliently reform and become smooth again when at the no, or weak, magnetic field point P2. Unlike conventional developer transporting surfaces with roughness formations that wear out over time, the smooth surface 102 advantageously results in a substantially improved extended life for the developer feeder assembly or roll 50 of the present invention.

As can be seen, an improved development apparatus 10 for developing a latent image recorded on an image bearing surface 14, has been provided and includes a housing 48 defining a chamber 46 that holds a supply of two-component developer material QS. The two-component developer material consists of toner and magnetizable carrier beads. The improved development apparatus 10 also includes a development zone DZ adjacent the image bearing surface 14, and a movable donor member 42 for moving toner fed from the chamber 46 through the development zone for image development. The improvement comprises a magnetic roll assembly 50 for moving a quantity QF of magnetically attracted developer material from the chamber into toner-transfer relation 54 with the donor member. The magnetic roll assembly 50 includes a rotatable non-conductive shell 90 surrounding the magnetic members M1 to M4 so as to prevent the creation of eddy currents during rotation of the shell about the magnetic members. An elastomeric coating layer 100 having a desired durometer hardness within a range of 60a to 70d is formed over the non-conductive shell and has a smooth surface 102 for holding the quantity of attracted developer material thereon. The smooth surface 102 as such, is magnetically deformable temporarily by magnetic forces of the strong magnetic fields of the magnetic members acting on magnetized carrier beads on the smooth surface 102.

The magnetic roll assembly as disclosed is also suitable for use generally in a development apparatus for moving magnetic or magnetizable developer material including toner particles and magnetizable carrier beads, along a desired path, for example, along a direct image development path between the mixing chamber and the development zone for image development. As illustrated, it is also particularly suitable for use in a donor type apparatus as a feeder assembly for feeding developer material from a mixing chamber to a donor member.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A development apparatus for developing a latent image recorded on an image bearing member, the development apparatus comprising:

(a) a housing storing a supply of magnetizable two-component developer material including toner particles and magnetizable carrier beads; and (b) a feeder assembly for transporting magnetized developer material from a mixing chamber to said feeder assembly including;

(i) a movable substrate having a first surface; a second surface, and a path of movement through said mixing chamber;

(ii) a magnetic member positioned adjacent said path of movement and said first surface of said movable substrate, said magnetic member generating a strong magnetic field about a first point along said path of movement; and (iii) a thin elastomeric coating formed on said second surface of said movable substrate and having a smooth surface for holding a quantity of magnetized developer material attracted thereonto at said first point, said smooth surface being mechanically deformable by magnetized carrier beads acting under said strong magnetic field to form decompressions for frictionally holding the quantity of magnetized developer material during transportation.

2. The development apparatus of claim 1, including a movable donor member mounted for receiving charged toner particles from said quantity of magnetized developer material on said smooth surface of said elastomeric coating, and for moving said toner particles through a development zone for developing the latent image.

3. The development apparatus of claim 1, wherein said movable donor member comprises a rotatable roll.

4. The development apparatus of claim 1, wherein said path of movement of said movable substrate is continuous and surrounds the position of said magnetic member.

5. The development apparatus of claim 4, wherein said movable substrate is a rigid cylindrical shell rotatable about said magnetic member.

6. The development apparatus of claim 5, wherein said cylindrical shell has a Modulus of Elasticity (E) of greater than 300,000 pounds per square inch.

7. The development apparatus of claim 5, wherein said cylindrical shell is about 475 mm long and has a center deflection of about 0.0016 inch when laden with said quantity of magnetizable developer material attracted thereonto.

8. The development apparatus of claim 1, wherein said movable substrate comprises electrically non-conductive material.

9. The development apparatus of claim 8, wherein said non-conductive movable substrate comprises a general purpose polycarbonate material.

10. The development apparatus of claim 8, wherein said non-conductive movable substrate comprises a urethane based polyester material.

11. The development apparatus of claim 10, wherein said movable substrate or shell has a Modulus of elasticity (E) of 300,000 pounds per square inch.

12. The development apparatus of claim 10, wherein said movable substrate has a resistivity of $10^8$ ohm-cm.

13. The development apparatus of claim 10, wherein said urethane based polyester movable substrate includes no elastomeric coating, and said second surface thereof comprises said mechanically deformable smooth surface of said feeder assembly.

14. The development apparatus of claim 1, wherein said thin elastomeric coating comprises electrically conductive material.

15. The development apparatus of claim 1, wherein said thin elastomeric coating comprises a urethane material.

16. The development apparatus of claim 1, wherein said thin elastomeric coating is mechanically deformable by a magnetic force of said magnetic field acting on magnetized carrier beads on said smooth surface of said coating.

17. The development apparatus of claim 16, wherein said elastomeric coating has a durometer hardness rating within a range of 60a to 70d.

18. The development apparatus of claim 16, wherein said thin elastomeric coating has a thickness within a range of 0.040 to 0.060 inches.

19. The development apparatus of claim 1, wherein said path of movement of said movable substrate includes at least a second point therealong that is being subject to a weak magnetic field.

20. The development apparatus of claim 19, wherein said smooth surface of said elastomeric coating being moved with said movable substrate is temporarily decompressed when at said first point along said path of movement by said magnetic force acting on said magnetized carrier beads thereon.

21. The development apparatus of claim 20, wherein said smooth surface of said elastomeric coating is temporarily restored from said decompression and becomes smooth when moving through said weak magnetic field.

22. An improved development apparatus for developing a latent image recorded on an image bearing surface, the development apparatus including a housing defining a chamber holding a supply of two-component developer material consisting of toner and magnetizable carrier beads, a development zone adjacent the image bearing surface, and a movable donor member for moving toner fed from the chamber through the development zone, the improvement comprising a magnetic roll assembly for moving a quantity of attracted developer material into toner-transfer relation with the donor member, said magnetic roll assembly including a magnetic member, a rotatable non-conductive shell surrounding said magnetic member, and an elastomeric coating layer formed over said non-conductive shell and having a smooth surface for holding, during transportation, said quantity of attracted developer material thereon, said smooth surface being mechanically deformable by magnetized carrier beads acting under the influence of said magnetic member.

23. A magnetic roll assembly for use in a development apparatus to move magnetizable developer material including toner particles and magnetizable carrier beads, the magnetic roll assembly comprising:

(a) a magnetic member generating a strong magnetic field;

(b) a rotatable cylindrical shell surrounding said magnetic member, said cylindrical shell including an outer surface having a path of rotation through said strong magnetic field of said magnetic member; and (c) an elastomeric coating formed over said outer surface of said cylindrical shell and having a smooth surface for holding a quantity of developer material magnetically attracted thereonto by said magnetic member, said smooth surface having a durometer hardness within a range of 60a to 70d, thereby enabling magnetized carrier beads in said quantity of attracted developer material to form temporary decompressions into said smooth surface when moving through said strong magnetic field of said magnetic member.

24. The development apparatus of claim 23, wherein said path of rotation of said magnetic roll includes a section adjacent an image bearing member defining a development zone for latent image development.

25. A development apparatus for developing a latent image recorded on an image bearing surface, the development apparatus including:

(a) a housing defining a chamber holding a supply of magnetizable developer material, said developer material including toner particles and magnetic carrier beads; and (b) a rotatable magnetic roll assembly mounted within said housing and having a path of rotation for moving a quantity of the developer material therealong, said rotatable magnetic roll assembly comprising:

(i) magnetic member generating a strong magnetic field at a first point along said path of rotation;

(ii) a rotatable cylindrical shell surrounding said magnetic member, said cylindrical shell including an outer surface for moving along said path of rotation; and (iii) an elastomeric coating formed onto said outer surface of said cylindrical shell and having a smooth surface for holding a quantity of said developer material magnetically attracted thereonto by said magnetic member, said smooth surface having a durometer hardness within a range of 60d to 70d, thereby allowing magnetic carrier beads in said quantity of developer material being held thereon to form temporary decompressions into said smooth surface when moving in said strong magnetic field.

* * * * *